US005090367A

United States Patent [19]

Shimada et al.

[11] Patent Number: 5,090,367

[45] Date of Patent: Feb. 25, 1992

[54] INTERNAL COMBUSTION ENGINE DISTRIBUTOR

[75] Inventors: Junichi Shimada; Kazutoshi Kobayashi, both of Katsuta, Japan

[73] Assignee: Hitachi, Ltd., Tokyo, Japan

[21] Appl. No.: 600,197

[22] Filed: Oct. 18, 1990

[30] Foreign Application Priority Data

Oct. 18, 1989 [JP] Japan ..... 1-268949

[51] Int. Cl.[5] ..... F02P 7/04

[52] U.S. Cl. ..... 123/146.50 A

[58] Field of Search ..... 123/146.5 A, 633, 647; 200/19 R

[56] References Cited

U.S. PATENT DOCUMENTS

| | | | |
|---|---|---|---|
| 2,619,513 | 11/1952 | Wolfenbarger | 123/595 |
| 4,453,526 | 6/1984 | Ito | 123/617 |
| 4,661,661 | 4/1987 | Kronberger | 123/146.5 A |
| 4,690,099 | 10/1990 | Shimada et al. | 123/146.5 A |
| 4,793,298 | 12/1988 | Arano et al. | 123/146.5 A |
| 4,907,563 | 3/1990 | Kodama | 123/146.5 A |

FOREIGN PATENT DOCUMENTS

| | | | |
|---|---|---|---|
| 862979 | 1/1953 | Fed. Rep. of Germany . | |
| 3109606 | 10/1982 | Fed. Rep. of Germany | 123/146.5 A |
| 2321604 | 3/1977 | France . | |
| 2459376 | 1/1981 | France . | |

OTHER PUBLICATIONS

Patent Abstracts of Japan, vol. 8, No. 32 (M-275)[1469]10th Feb. 1984.

*Primary Examiner*—Tony M. Argenbright
*Attorney, Agent, or Firm*—Ladas & Parry

[57] ABSTRACT

A distributor for H.T. electrical voltage in an internal combustion engine has a base (2) supporting a cap (60). A shaft (1) arranged to rotate in synchronism with the engine rotation drives an apertured rotating plate (8) which is positioned between a light transmitter and a light receiver forming a signal detection unit (15). Signals from the signal detection unit (15) are outputted via a connector (51). The distributor has an H.T. voltage distribution portion formed by a rotor (14), contacts (20,22) and rotor contact (21). The H.T. voltage portion of the distributor is separated from the signal detection unit (15) by an inverted cup-shaped insulating cover (17) located substantially inside the cap (60). The cover (17) is sealed to the base by an annular seal (18) and to the cap by an annular seal (19). A further seal (82) which is preferably integral with the seal (18) is located about the connector (51) and seals the cover (17) to the connector (51). A ventilation hole (71) may be provided through the cover to vent the H.T. voltage distribution portion to the exterior of the distributor.

12 Claims, 5 Drawing Sheets

INTERNAL COMBUSTION ENGINE DISTRIBUTOR

BACKGROUND OF THE INVENTION

1. Field of the Invention

This invention relates to a distributor for high tension (H.T.) electrical voltage in an internal combustion engine.

2. Description of Related Art

In a known distributor, an insulating resin cover is provided between a H.T. distributing portion connecting to spark plugs and a signal detection portion for producing signals in synchronism with engine rotation. A cap encompasses the distribution and signal detection portions and a connector extends through a circumferential side wall of a metallic cup-shaped base on which the cap locates. The connector connects the signal detector portion with, for example, an ignition advance angle mechanism. The base includes a ventilation hole and a drainage hole. So as to ensure a waterproof fit around the connector there is shown in FIG. 5 of the reference an elastic member on the side of the distributor and a plate fixed by screws so that the elastic member is pressed between the connector and the plate.

With the above known distributor, a large number of parts are required, and complex and diversified manufacturing operations are required so that both material costs and assembly costs are expensive. Further, because the connector extends through an opening in the base side wall, the mating surface between the base and the cap is formed above the connector, therefore the height of the distributor is high for ensuring an adequate distance between the high voltage distributor portion and the earthing portion of the base.

An object of the present invention is to reduce the size, the weight and the manufacturing cost of the distributor, in particular, to eliminate the metallic circumferential wall of the distributor base.

SUMMARY OF THE INVENTION

According to this invention there is provided a distributor for a high tension electrical voltage in an internal combustion engine comprising a base supporting a cap, an engine crankshaft rotation signal detection means and an H.T. electrical voltage distribution means located within the cap, a connector adapted to connect output signals from the signal detection means to outside said cap, and an inverted cup-shaped insulating cover located on the base adapted to provide a partition between the signal detection means and the distribution means.

In one embodiment said cover has a cut-out to permit said connector therethrough.

In one embodiment of the invention the cut-out closely conforms to the configuration of the connector so that the cover effectively forms a cover on the base surrounding the signal detection means and thereby forms a lower peripheral wall of the distributor. In such an embodiment the cover is sealed to the base by a sealing ring. In such an arrangement conveniently the ring is formed by a first annular portion which is positioned between the cover, the connector and the base, and a further annular portion which is orthogonal to the portion and which portion forms a seal between the cover and the connector. Preferably another seal is located between the cover and the cap.

Advantageously, the base is substantially flat and the cap and the cover adjacent the base are substantially in the same plane.

Advantageously, the cover is provided with an aperture extending from a side of said cover remote from said base and in a region locating said H.T. electrical voltage distribution means to externally of the cover.

In an alternative embodiment, the cover has an enlarged cut-out about the connector and the cover is encompassed by the cap, the cap having a cut-out which is adapted to provide a seal about the connector.

Advantageously, the first and further seal portions are integrally connected with one another.

In a preferred embodiment the cover has a continuous side wall, a lower portion of the cover being sealed to the base via seal means, an upper portion of the cover being sealed to the cap via a further seal means, and the connector passes through an aperture in the base and is sealed therewith by another seal means.

According to another aspect of this invention in a distributor for high tension electrical voltage in an internal combustion engine, the distributor comprising a base supporting a cap, an engine crankshaft rotation signal detection means and an H.T. electrical voltage distribution means, a connector adapted to connect output signals from the signal detector means to outside said cap, and an inverted cup-shaped insulating cover located on the base inside said cap having a cut-out about the connector, there is provided a seal means comprising a first annular portion sandwiched between the cover and the base and a second annular portion sandwiched between the cover and the connector, the first and second seal portions being perpendicular to one another and integrally formed with one another.

Thus, the present invention provides an inverted cup-shaped cover substantially inside a cap which cover provides insulation between a signal detection means and an H.T. electrical voltage distribution means, the cover in one embodiment closely sealing with an output connector of the signal detecting means, in another embodiment the cap closely sealing with the output connector, and in another embodiment providing a continuous seal with the base. By providing a base of the distributor which is substantially flat and a cover interposed between the base and the H.T. electrodes, the overall axial height of the distributor may be reduced without fear of an electrical leakage path being formed between the H.T. electrical voltage distribution means and the base which is at ground potential. By the use of sealing members, waterproof seals are obtained to prevent ingress of water to the distributor so that damage does not occur to the signal detection means. The cover also has the advantage of having a ventilation hole for the ozone produced at the H.T. electrical voltage distribution means.

BRIEF DESCRIPTION OF THE DRAWINGS

The invention will now be described, by way of example, with reference to the accompanying drawings in which.

In the Figures, like reference numerals denote like parts.

DESCRIPTION OF PREFERRED EMBODIMENTS

Figure 1:
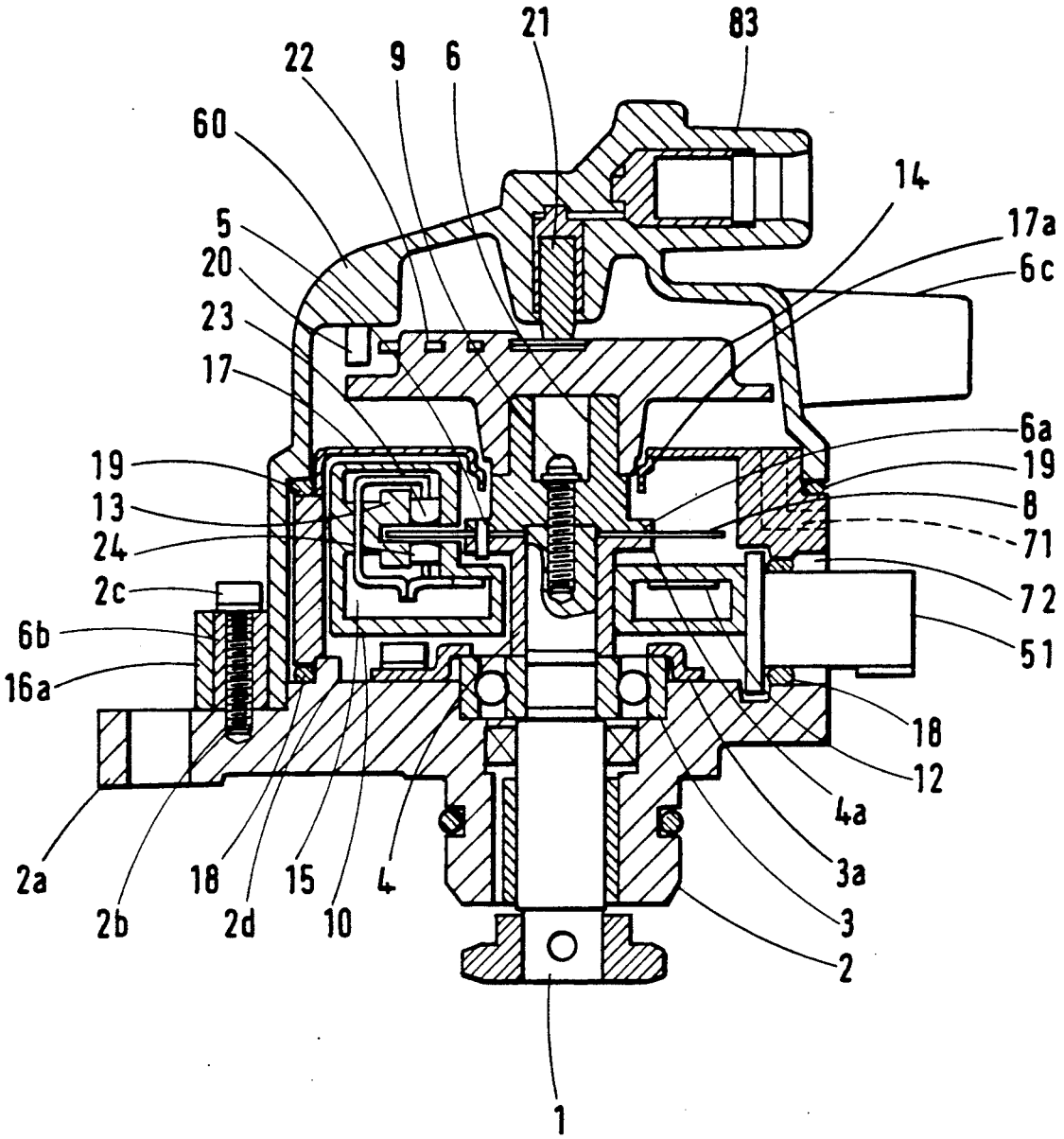
FIG. 1 is a cross-sectional view of one embodiment of a distributor in accordance with this present invention.
Figure 2:
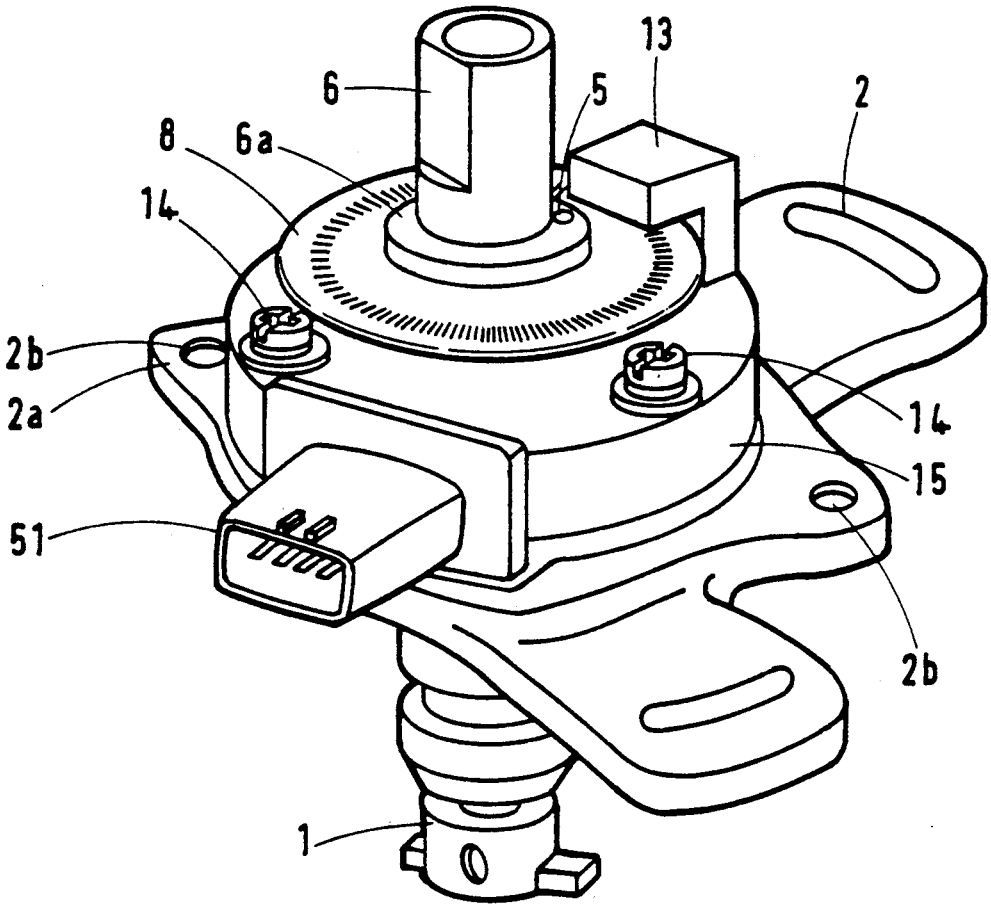
FIG. 2 is a perspective view in which the distributor cap and the insulator cover shown in FIG. 1 are removed.
Figure 3:
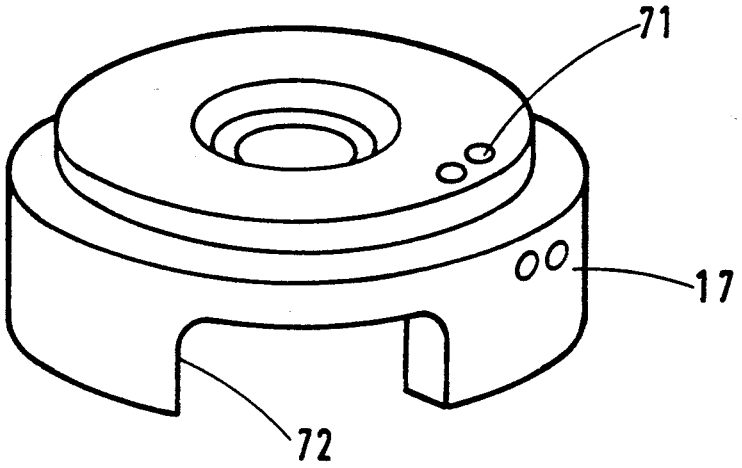
FIG. 3 is a perspective view of the insulating cover shown in FIG. 1.
Figure 4:
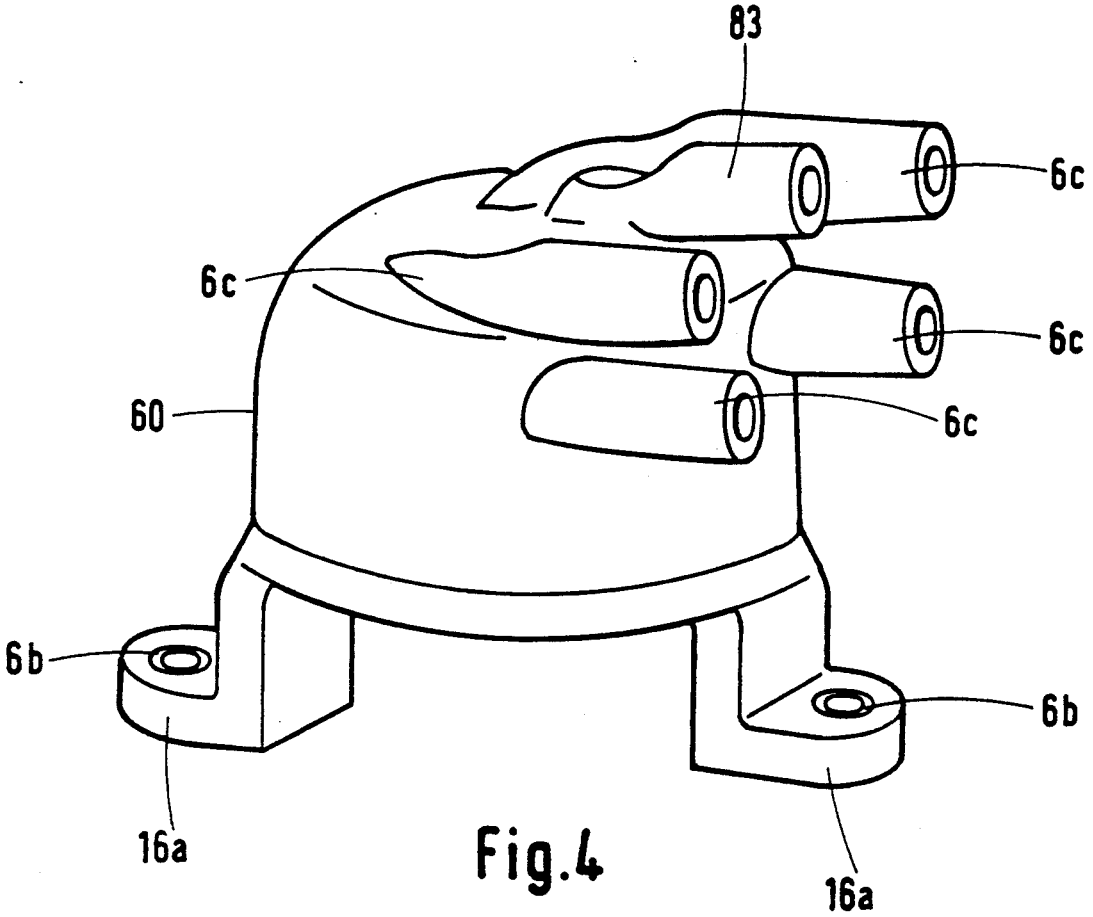
FIG. 4 is a perspective view of the distributor cap shown in FIG. 1, FIG. 5(*a*) is a view showing the seal in use, and FIG. 5(*b*) is a view showing the seal before use.

The distributor shown in FIGS. 1 to 4 has a base 2 supporting a cap 60, and a distributor shaft 1, arranged to rotate in synchronism with an engine but at half the engine crankshaft revolution speed, is located through a hole in the base and supported by a bearing 3 which is held in position on the base by a holder 3*a*.

At one end of the distributor shaft 1 is secured a first collar 4 having a flange 4*a*, the flange 4*a* facing a flange 6*a* of a second collar 6 and the flanges 4*a*, 6*a* being connected by a pin 5 located in holes in the respective flanges. Between the flanges 4*a* and 6*a* is sandwiched an apertured rotating plate 8, the second collar 6 and the first collar 4 being press-contacted to a stepped portion of the shaft 1.

A case 10 made of a synthetic resin, circumferentially surrounds collar 4 and houses a hybrid integrated circuit 12, a light receiving element 24, and a photoelectric type pickup !3 including a holder provided with a light emitting element 23. The elements 23 and 24 are disposed on opposing sides of the apertured plate 8 for determining the engine crankshaft angle and output signals sent via a connector 51 disposed through a gap in the cap side wall are provided for utilization by a control device.

The shaft 1 is arranged to rotate in synchronism with the rotation of the engine (not shown), optical signals intermittently interrupted by the rotating disc 8 are converted into electrical signals by the integrated circuit, and crank angle position signals of the engine are transmitted from the signal detection unit 15 via the connector portion 51 to a control device (not shown) for controlling the engine.

The case 10 is secured by a screw (not shown) to the bottom of the base. Hereinbelow, the assembly of the hybrid integrated circuit 12 and the photoelectric type pickup 13 is referred to a signal detection unit 15.

The base 2 has a flange 2*a* in which a screw hole 2*b* is formed and by inserting a screw 2*c* into a metal bush 6*b* molded to an attachment leg 16*a* of the distributor cap 60, so the distributor cap is secured to the base 2. Between the base 2 and the distributor cap 60 is an inverted cup-shaped cover 17 made of polybutylenetelephthalate having an opening 72 for accommodating the connector 51. The cover is sealed by elastic seal members 18, 19 disposed respectively between the base 2 and the cover 17, and between the cap 60 and the cover 17. The cover 17 is provided with a pair of ventilation holes 71 communicating the interior of the distributor cap 60 to the exterior thereof. The cover 17 has a cut-out 72 to accommodate the connector 51 therethrough.

Figure 5A:
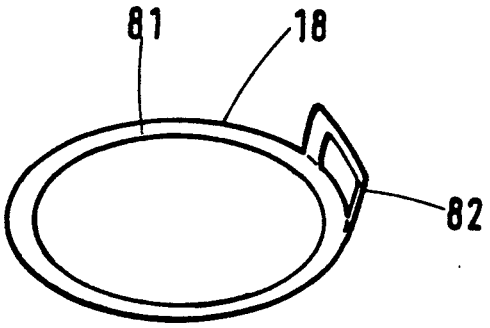
Figure 5B:
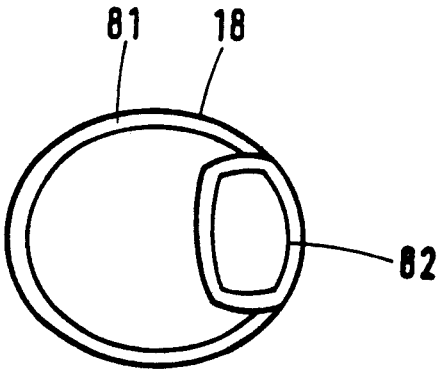

The elastic seal member 18, shown in FIGS. 5(*a*) and 5(*b*), is composed of an annular elastic seal member portion 81 which is interposed between the cover 17 and the base and an annular elastic seal member portion 82 which is inteposed between the connector 51 and the cover 17. The seal member portions 81, 82 are each angularly formed in the same plane as shown in FIG. 5(*b*), and the smaller annular portion 82 is used around connector 51 to be perpendicular with respect to portion 81, as shown in FIG. 5(*a*). The seal member 19 is annularly shaped.

The upper face of the base 2 is substantially flat with only a small annular step 2*d*. In this respect, the insulation cover 17 surrounding the signal detection unit 15 is provided with a circumferential wall which constitutes an internal lower half circumferential wall of the distributor. The upper half circumferential wall and part of the outer lower circumferential wall of the distributor are formed by the distributor cap 60.

In this embodiment, an H.T. electrical voltage distribution chamber is formed between the cover 17 and the distributor cap 60, and below this chamber is formed a signal detection unit chamber which is formed between the cover 17 and the housing 2.

On the axial center portion of the cover 17 a stepped portion 17*a* is formed which constitutes a labyrinth passage between the circumferential portion of the collar 6 inserted thereinto. Thereby ozone and electrode powder due to electric discharge which are generated in the upper voltage distribution chamber are prevented from intruding into the lower signal detection unit 15 accommodating chamber.

In the H.T. electrical voltage distribution chamber is a side electrode 20 which is integrally molded with the distributor cap 60. A center electrode 21 is provided for transmitting the high voltage from an ignition coil (not shown) to electrodes 22 of a rotor !4 via a high voltage tower 83 and a high voltage tower 6*c* is provided for transmitting high voltage distributed to the side electrode 20 from the rotor electrode 22 to ignition spark plugs (not shown).

The method of assembly will now be described.

The shaft 1 is supported on the base 2 via bearing 3. Around the connector portion 51 of the signal detection unit 15, is disposed the smaller annular portion 82 of the elastic seal member 18 and the larger annular portion 81 is disposed around the annular stepped portion 2*d* of the base 2 and thereafter the unit 15 is fixed to the housing 2 by a screw 14 (shown in FIG. 2).

The rotatable plate 8 is sandwiched between the collars 6 and 4 and fixedly secured by the pin 5, and the rotatable plate 8 is inserted in the gap between the light emitting and receiving elements 23, 24 of the photoelectric type pickup 13 while inserting the collar 4 into the center aperture of the signal detection unit 15.

Next, the cover 17 is located so that the opening 72 of the cover 17 fits over the connector 51.

A screw 9 is then inserted through the center of the collar 6 to secure the collar assembly to the shaft 1. Thereafter, the distributor rotor 14 is secured to the upper end of the collar 6.

On the outer circumferential stepped portion of the cover 17 is disposed the annular elastic member 19 for sealing the distributor cap 60, the bush 6*b* of the attachment leg 16*a* of the cap being mated with the screw hole 2*b* of the base 2 and the screw 2*c* secure to the housing 2.

The force exerted by the cap 60 pressing onto the housing is transmitted to the cover 17 via the elastic seal members 18 and 19 such that the cap 60 and the cover 17 are secured to the housing.

A waterproof structure of the connector 51 is formed wherein the side wall cut-out 72 of the cover 17 presses the elastic seal member 18 around the connector 51, and further, the structure provides the cover 17 with the ventilation holes 71 communicating the inside of the distribution chamber to the outside thereof to facilitate discharge of gases, such as ozone generated at the rotor, thereby, a stable ventilation performance and waterproof performance are obtained. Further sufficient distance from the H.T. voltage distribution chamber 20 to the surface of the base 2 at ground potential is maintained. Accordingly, the total height of the distributor is reduced, and the seal structure of the connector is simplified. As a result, the distributor is excellent in terms of light weight and reduction in production cost.

Figure 6:
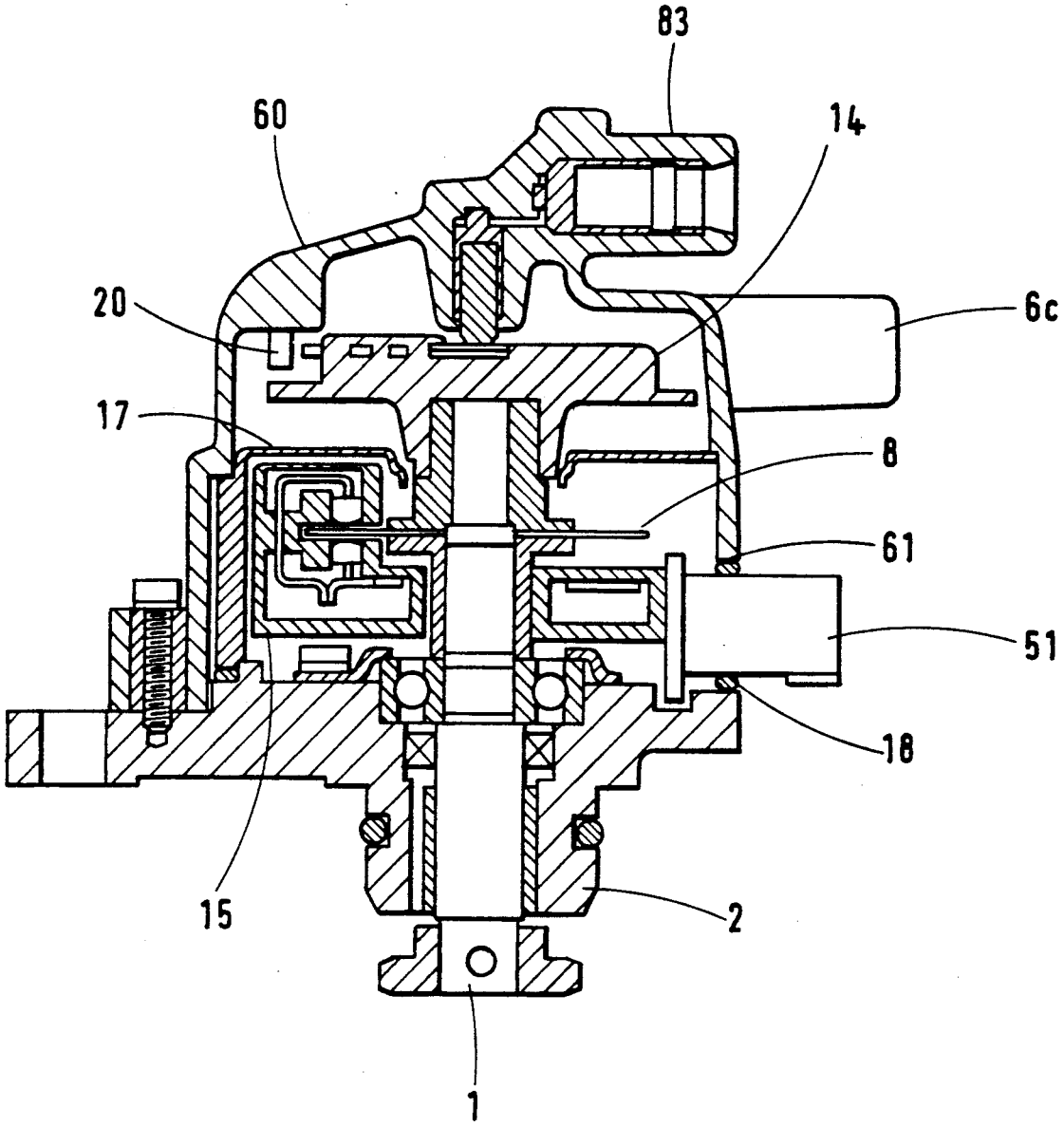
FIG. 6 is a cross-sectional view showing another embodiment of the present invention.

In the alternative embodiment of FIG. 6, the size of the opening 72 of the cover is formed much larger than the connector 51 and the side wall of the distributor cap 60 is now provided with a cut-out 61 for sealingly mating with the connector 51 via an annular elastic seal member 18. In such an embodiment seal member 19 is eliminated so that a further reduction in the number of assembly parts is achieved.

Figure 7:
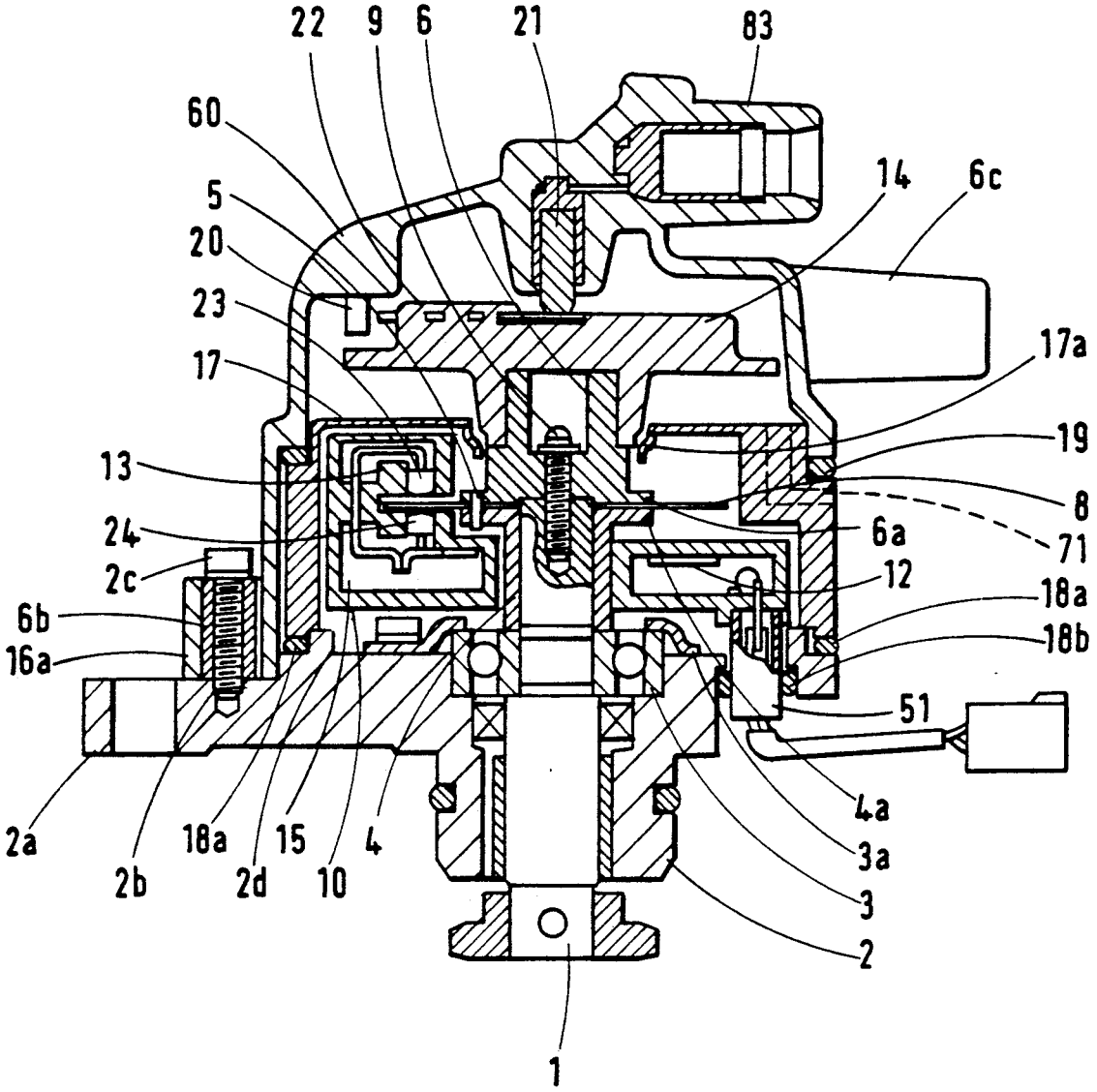
FIG. 7 shows further embodiment of this invention.

In the further embodiment of FIG. 7, the construction is further simplified by providing a cover 17 with a continuous side wall, the cap 60 being located on the cover by the "O" ring seal 19, the cover being located on the base via an "O" ring seal 18*a* and the connector 51 passing through and being sealed to the base 2 by another "O" ring seal 18*b*.

Also, in the alternative embodiment of FIG. 7, by providing a distributor cap which covers the entire circumference of the cover 17, a double cover is formed so that water penetration is further prevented.

It is to be understood that the signal detection unit accommodated inside the cover 17 is not limited to the crank angle sensor of the photoelectric pickup type described above and may be a magnetic pickup type or an ignition signal generation device.

In the present invention as explained above, since the circumferential wall of the inverted cup-shaped insulating cover which covers over the flat base of the distributor forms a circumferential wall of the distributor, the number of metal parts of the distributor are reduced and the weight thereof is reduced and, as well, the diameter thereof is reduced so that a compact distributor is realized.

Further, by the structure of the present invention, base 2 which functions as the ground potential for the distributor is located far from the high voltage distribution portion so the axial length of the distributor may be shortened due to the interposition of the insulating cover.

It is to be understood that the invention has been described with reference to exemplary embodiments and modifications may be made without departing from the spirit and scope of the invention as defined in the appended claims.

We claim:

1. A distributor for a high tension electrical voltage in an internal combustion engine comprising a base supporting a cap, an engine crankshaft rotation signal detection means and an H.T. electrical voltage distribution means located within the cap, a connector adapted to connect output signals from the signal detection means to outside said cap, and an inverted cup-shaped insulating cover located on the base adapted to provide a partition between the signal detection means and the distribution means, said cover having a cut-out to permit said connector therethrough.

2. A distributor according to claim 1 wherein the cut-out closely conforms to the configuration of the connector so that the cover effectively forms a cover on the base surrounding the signal detection means and thereby forms a lower peripheral wall of the distributor.

3. A distributor according to claim 2 wherein the cover is sealed to the base by a sealing ring.

4. A distributor according to claim 3 wherein the ring is formed by a first annular portion which is positioned between the cover, the connector and the base, and a further annular portion which is orthogonal to the first portion and which further portion forms a seal between the cover and the connector.

5. A distributor according to claim 4 wherein another seal is located between the cover and the cap.

6. A distributor according to claim 1 wherein the cover has an enlarged cut-out about the connector and the cover is encompassed by the capy, the cap having a cut-out which is adapted to provide a seal about the connector.

7. A distributor according to claim 3 wherein the first and further seal portions are integrally connected with one another.

8. A distributor according to claim 1 wherein the base is substantially flat and the cap and the cover adjacent the base are substantially in the same plane.

9. A distributor according to claim 1 wherein the cover is provided with an aperture extending from a side of said cover remote from said base and in a region locating said H.T. electrical voltage distribution means to externally of the cover.

10. A distributor according to claim 1 wherein the cover has a continuous side wall, a lower portion of the cover being sealed to the base via seal means, an upper portion of the cover being sealed to the cap via a further seal means, and the connector passes through an aperture in the base and is sealed therewith by another seal means.

11. In a distributor for high tension in an internal combustion engine comprising a base supporting a cap, an engine crankshaft rotation signal detection means and an H.T. electrical voltage distribution means, a connector adapted to connect output signals from the signal detector means to outside said cap, and an inverted cup-shaped insulating cover located on the base inside said cap having a cut-out about the connector, there is provided a seal means comprising a first annular portion sandwiched between the cover and the base and a second portion sandwiched between the cover and the connector, the first and second seal portions being perpendicular to one another and integrally formed with one another.

12. A distributor for a high tension electrical voltage in an internal combustion engine comprising a base supporting a cap, an engine crankshaft rotation signal detection means and an H.T. electrical voltage distribution means located within the cap, a connector adapted to connect output signals from the signal detection means to outside said cap, an inverted cup-shaped insulating cover located on the base adapted to provide a partition between the signal detection means and the distribution means, said cover having a cut-out to permit said connector therethrough and said cut-out closely conforming to the configuration of the connector so that the cover effectively forms a cover on the base surrounding the signal detection means and thereby forms a lower peripheral wall of the distributor.

* * * * *